US005205798A

United States Patent [19]

Lekhtman

[11] Patent Number: 5,205,798

[45] Date of Patent: Apr. 27, 1993

[54] SPORTING AND EXERCISING UNIT

[75] Inventor: Gregory Lekhtman, Montreal, Canada

[73] Assignee: Unique Life and Fitness Products Corp., Plattsburgh, N.Y.

[21] Appl. No.: 838,461

[22] Filed: Feb. 19, 1992

[51] Int. Cl.[5] ..... A63B 25/10

[52] U.S. Cl. ..... 482/77; 482/79; 482/124; 482/121

[58] Field of Search ..... 482/77, 79, 121, 122, 482/124

[56] References Cited

U.S. PATENT DOCUMENTS

| | | | |
|---|---|---|---|
| 4,196,903 | 4/1980 | Illustrato | 482/77 |
| 4,492,374 | 1/1985 | Lekhtman et al. | 482/77 |
| 4,534,124 | 8/1985 | Schnell | 482/77 |
| 4,660,299 | 4/1987 | Omilusik | 482/77 |
| 4,774,776 | 10/1988 | Gulli | 482/77 |
| 4,912,859 | 4/1990 | Ritts | 482/77 |
| 5,002,294 | 3/1991 | Franz | 482/77 |

*Primary Examiner*—Richard J. Apley
*Assistant Examiner*—Lynne Reichard
*Attorney, Agent, or Firm*—Chilton, Alix & Van Kirk

[57] ABSTRACT

A foot receiving member has a spring member detachably attached to the bottom surface thereof. The spring member includes a top, arched, layer and a bottom, arched, layer and a strap disposed between the two arched layers. The arched layers are attached, at their ends, to a corresponding end of the strap in such a manner that the spring member will be automatically disassembled under the influence of an extraordinary lateral force.

6 Claims, 2 Drawing Sheets

Fig. 3
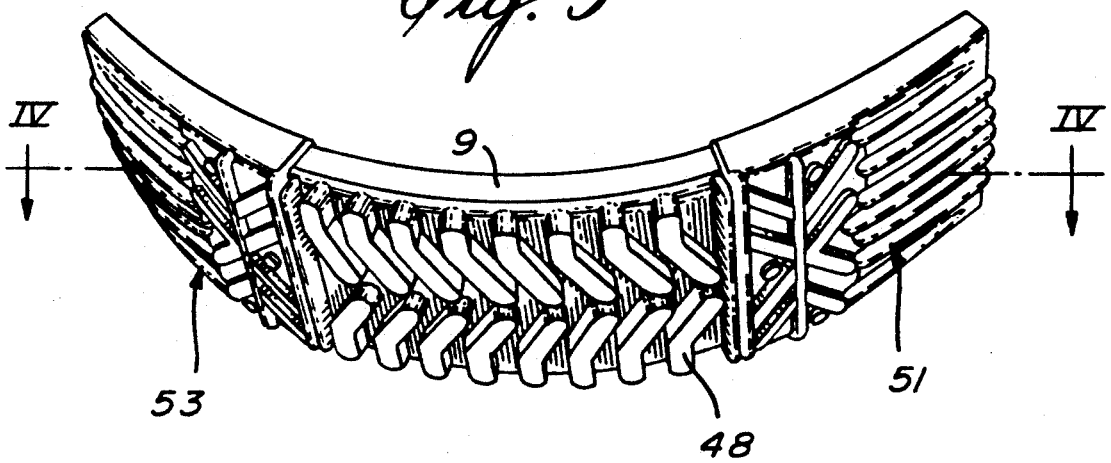
Fig. 4
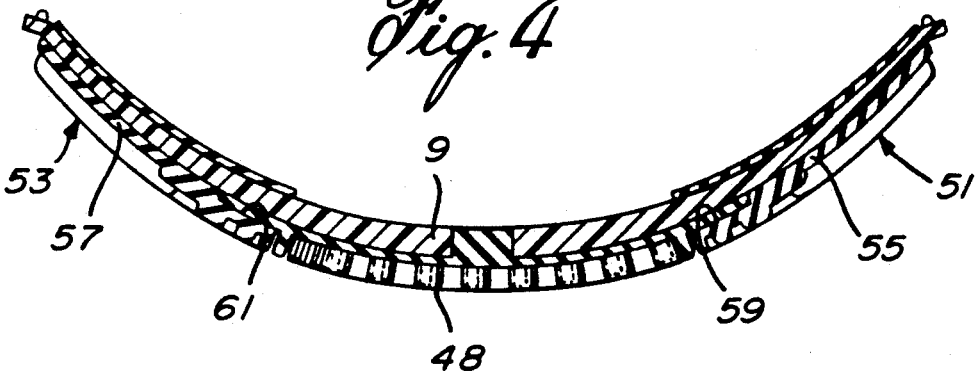
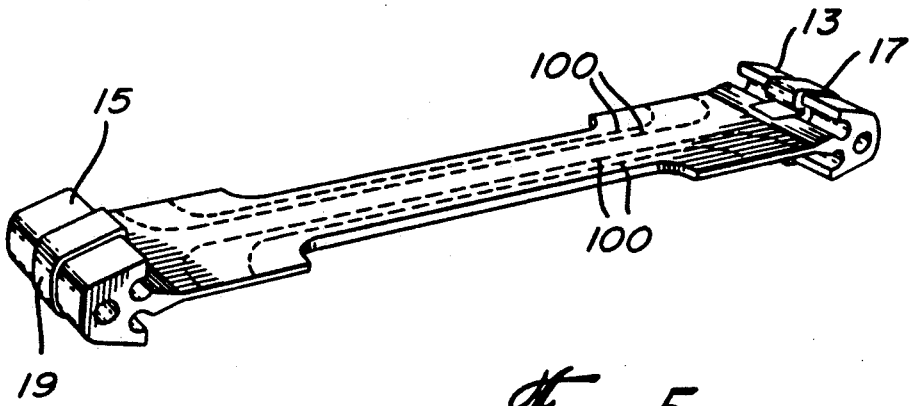
Fig. 5

SPORTING AND EXERCISING UNIT

BACKGROUND OF INVENTION

1. Field of the Invention

The invention relates to a sporting and exercising unit comprising a foot receiving member and a spring member attached to and disposed at the bottom of the foot receiving member. More specifically, the invention relates to such a unit which comprises a novel structure for the spring member which is removably attached to the bottom of the foot receiving member 2. Description of Prior Art Such sporting and exercising devices are known in the prior art as shown, for example, in our U.S. Pat. No. 4,492,374, Lekhtman et al, Jan. 8, 1985. However, the unit as taught in the '374 patent has some shortcomings as follows:

1. As the spring member is permanently attached to the foot receiving member, the entire assembled unit as illustrated in FIG. 1 of the patent must be carried around in its assembled form. This can be inconvenient.
2. The layers 5 and 7 which form the spring member are attached to each other and to a spring rate and weight adjustment mechanism 13 by an arrangement which includes a buckle 33, a bar 35 and a circular rubber member 39. Because of the nature of the attachment assembly, the spring member does not automatically disassemble under conditions of extraordinary force and this could be dangerous. For example, if a user should tread on the edge of a sidewalk, the arrangement would bend under the user so that the user would fall and possibly sustain injuries as well as sprained or broken ankles.
3. Because of the need for metallic members 13, 15 and 17 in the '374 patent, the unit is relatively heavy.
4. The spring rate and weight adjustment mechanism 13 is cumbersome and heavy.

SUMMARY OF INVENTION

It is therefore an object of the invention to provide an arrangement for a spring member which provides safety features.

It is a further object of the invention to provide a spring member which is completely detachable from the foot receiving member so that the disassembled spring member can be stored in the foot receiving member.

It is a still further object of the invention to provide a spring member which is entirely made of plastic whereby to reduce the durability and weight of the spring member.

It is a still further object of the invention to provide a variable spring rate and weight adjustment means.

In accordance with the invention, there is provided a sporting and exercising unit comprising:

A) a foot receiving member;

B) a plastic spring member detachably attached to and disposed at the bottom of the foot receiving member, said spring member comprising:

i) a top, arched, layer having a first end and a second end;

ii) a bottom, arched, layer having a first end, a second end, a bottom surface and a top surface;

iii) spring rate and weight adjustment means having a first end and a second end, said spring rate and weight adjustment means being disposed between said top and bottom layers;

iv) the first end of the top layer and the first end of the bottom layer being disassemblingly attached to the first end of the spring rate and weight adjustment means, and the second end of the top layer and the second end of the bottom layer being disassemblingly attached to the second end of the spring rate and weight adjustment means;

whereby, the spring member will automatically disassemble under the influence of an extraordinary lateral force.

BRIEF DESCRIPTION OF DRAWINGS

The invention will be better understood by an the accompanying drawings, in which:

FIG. 3 illustrates an alternate means for detachably mounting the sole on the bottom surface of the bottom layer;

FIG. 4 is a cross-section through IV—IV of FIG. 3; and

FIG. 5 illustrates a calibrated spring rate and weight adjustment means.

DESCRIPTION OF PREFERRED EMBODIMENTS

Figure 1:
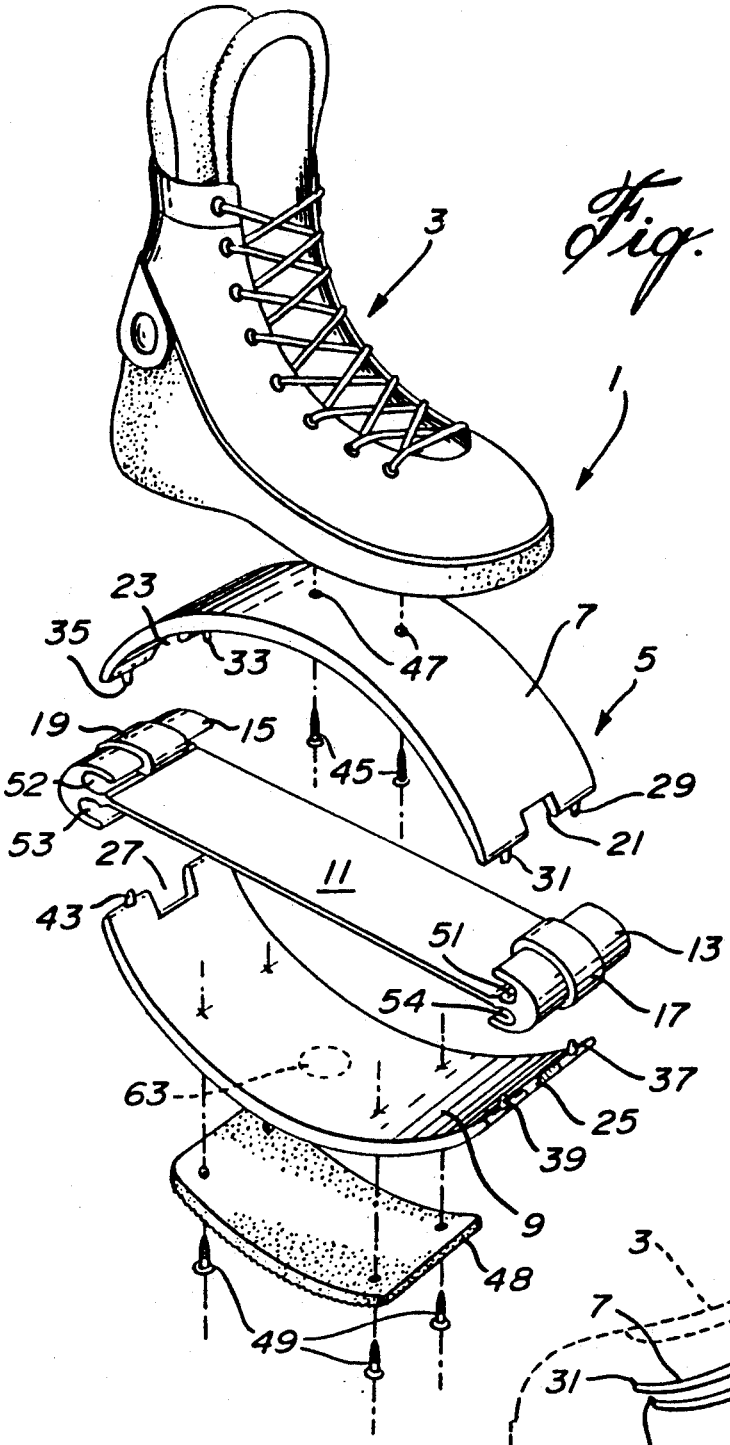
FIG. 1 illustrates the shoe receiving member and the spring member in exploded form.

Referring to the drawings, the sporting and exercising unit, illustrated generally at 1, comprises a foot receiving member 3 and a spring member 5. The foot receiving member can be made adjustable as taught in U.S. Pat. No. 4,492,374. Alternatively, it can comprise a sized boot as illustrated in FIG. 1.

The spring member 5 comprises a top layer 7 and a bottom layer 9. Both top and bottom layers 7 and 9 are made of a sturdy, flexible plastic material. As seen, layers 7 and 9 are arched so that when the spring member is assembled, it will have an annular shape, e.g., an oval shape.

Disposed between the top and bottom layers 7 and 9 is a spring rate and weight adjustment means comprising a plastic strap 11. To provide a greater resistance, or to support a greater weight, a heavier and thicker strap 11 is used. Alternatively, to provide less resistance and to support a smaller weight, a lighter less thick plastic strap is used.

However, all of the above variations are factory adjustments. In order to maintain adequate selection, a retailer must retain a large inventory.

The inventory requirement can be reduced, in accordance with a feature of the invention, by making the plastic strap 11 of a material which can be whittled down to adjust the magnitude of the spring rate and weight adjustment means. In accordance with a preferred feature of the invention, the strap 11 includes calibration markings 100 on at least one of its surfaces as seen in FIG. 5. The strap would be whittled by the end user to the calibration marking appropriate to his particular requirements.

The strap 11 has a first end and a second end, and a pad 13 covers the first end while a pad 15 covers the second end. Strip 17 overlies the pad 13 and strip 19 overlies the pad 15. In a preferred embodiment, the strips 17 and 19 are aligned with each other and are disposed centrally of the pads 13 and 15 respectively.

Each layer 7 and 9 has a first end and a second end. Indents 21 and 23 are included at the first and second ends respectively of the layer 7, and mating indents 25 and 27 are included at the first and second ends respectively of the layer 9. The width of the indents is such that the indents can be snap-fitted onto respective ones of the strips 17 and 19. Thus, indent 21 is snap-fitted on the top of strip 17 while indent 25 is snap-fitted on the bottom of strip 17. In a like manner, indent 23 is snap-fitted on the top of strip 19 and indent 27 is snap-fitted on the bottom of strip 19.

Nipples 29 and 31 extend from the first end of the layer 7, and nipples 33 and 35 extend from the second end of layer 7. In a like manner, nipples 37 and 39 extend from the first end of the layer 9, and nipples 41 and 43 extend from the second end of the layer 9. When the spring member is assembled, the nipples will abut respective edges of the pads 13 and 15.

The top layer 7 is detachably fastened to the foot receiving member by screws 45 which extend through openings 47 in the layer 7. Preferably, screw receiving bolts are mounted in the sole of the foot receiving member 3 to receive the screws 45. Thus, the top layer 7 is easily attached to or detached from the foot receiving member 3.

A sole 48 is detachably attached to the bottom surface of the layer 9. The sole 48 is attached to the layer 9 by screws 49. Once again, preferably screw receiving bolts are mounted in the layer 9 to receive the screws 49.

In operation, the top layer 7 is first attached to the foot receiving member 3 by screws 45 as above-described. Indent 21 is then snap-fitted onto the top of strip 17 and indent 23 is snap-fitted onto the top of strip 19.

The sole 48 is mounted on the bottom surface of layer 9 by screws 49 as above-described. The indent 25 is then snap-fitted on the bottom of strip 17, and indent 27 is snap-fitted on the bottom of strip 19. Nipples 29 and 37 will abut the right-hand edge of pad 13 while nipples 31 and 39 will abut the left-hand edge of pad 13. Nipples 33 and 41 will abut the right-hand edge of pad 15 and nipples 35 and 43 will abut the left-hand edge of pad 15. The nipples will prevent lateral movement of the layers 7 and 9 relative to the strap 11 and vice-versa when only a small, normal, lateral force is applied. However, when a strong lateral force is applied (for example, when a user steps on the edge of a sidewalk), the strong lateral force will overcome the holding restraint of the nipples to permit lateral movement of the layers 7 and 9 relative to the strap 11 or vice-versa. The snap fits of the indents on the strips will then come undone so that the entire unit will be disassembled and the strap 11 and layer 9 will fall away from the layer 7. Thus, the user will step on the relatively flat surface of the layer 7 to thereby avoid falling or twisting and spraining of ankles. Thus, the automatic disassembly of the spring member under the influence of an exraordinary lateral force provides a safety feature not available in the prior art.

The bottom of the sole 48 will comprise a tread. As such treads will wear with use, it is an advantage of the present invention that the sole is sole when an old sole is worn beyond further use. detachably mounted so that it can be replaced by a new A problem with the above-identified embodiment for detachably mounting the tread on the bottom surface of the bottom layer 9 is that, when small screws are used, the forces applied when the unit is in use tend to pull the screw heads through the sole so that the sole will eventually fall off. If larger screws are used, then the bottom layer will be damaged.

In order to overcome the above disadvantages, an alternate arrangement is provided for detachably mounting the sole on the bottom surface of the bottom layer. The arrangement is illustrated in FIGS. 3 and 4. Referring to FIGS. 3 and 4, it can be seen that a means 51 is provided for releasably holding one end of the sole 48, and a second means 53, spaced from 51 by a gap into which the sole fits, is provided for releasably holding the other end of the sole 48. In the preferred embodiment, as illustrated in FIG. 4, the means 51 comprises a pocket 55 formed at one end of the bottom surface of the bottom layer, and the means 53 comprises a second pocket 57 formed at the other end of the bottom surface of the bottom layer. Preferably, the means 51 and 53 and the sole 48 are made of the same sturdy, flexible plastic material as are the remaining parts of the spring member 5.

As seen in FIG. 4, sole 48 preferably comprises a step 59 at one end, and a step 61 at the other end thereof. The steps are provided so that, when the sole is placed with its respective ends in the respective pockets, slippage of the sole within the pockets will be prevented.

In addition, it has been found that the forces applied to the bottom layer cause the bottom layer to stretch, and the pulling forces applied when the bottom layer is stretched cause a good deal of stress at the center of the bottom layer. To relieve this stress, a cut-out portion 63 is drilled in the center of the bottom layer, as illustrated in dotted lines in FIG. 1.

The sole is easily inserted into the pockets by bending it and inserting respective ends of the sole into their respective pockets. The sole is then released, whereupon it will spring back to its original shape.

Figure 2:
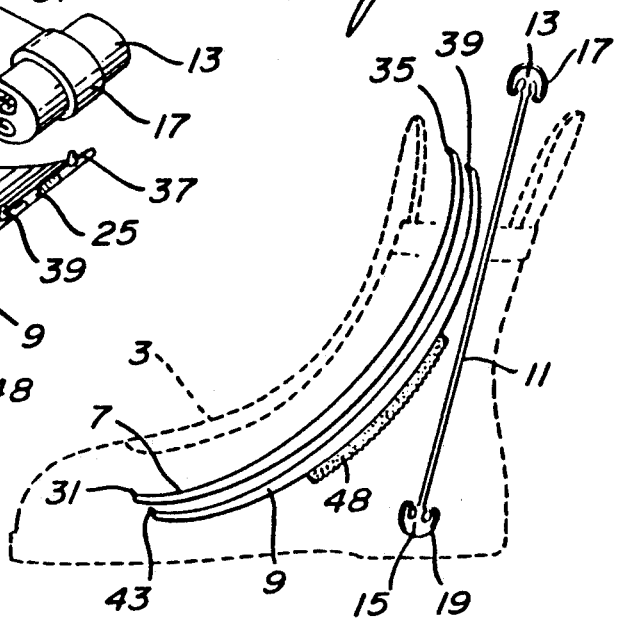
FIG. 2 illustrates how the disassembled spring member can be stored in the foot receiving member.

In addition to being able to disassemble the spring member by an extraordinary lateral force, it is also possible to disassemble the spring member using simple hand force. In addition, it is a relatively simple matter to detach layer 7 from the foot receiving member 3 when the unit is not in use. All of the parts forming the spring member can then be stored in the foot receiving member as illustrated in FIG. 2. Accordingly, the unit is more portable than units of the prior art.

In addition, because all of the parts of the spring member are made of plastic and none of the parts are made of steel, the entire unit weighs less than units of the prior art which makes the inventive unit that much more portable.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A sporting and exercising unit, comprising:

A) a foot receiving member;

B) a plastic spring member detachably attached to and disposed at the bottom of the foot receiving member, said spring member comprising:

i) a top, arched, layer having a first end and a second end;

ii) a bottom, arched, layer having a first end, a second end, a bottom surface and a top surface;

iii) spring rate and weight adjustment means having a first end and a second end, said spring rate and weight adjustment means being disposed between said top and bottom layers;

iv) the first end of the top layer and the first end of the bottom layer being disassemblingly attached to the first end of the spring rate and weight adjustment means, and the second end of the top layer and the second end of the bottom layer being disassemblingly attached to the second end of the spring rate and weight adjustment means;

said spring rate and weight adjustment means comprising a strap member having a first end and a second end;

a first snap-fitting means at said first end of said strap, and a second snap-fitting means at said second end of said strap;

said first end of said top layer and said first end of said bottom layer being snap-fittingly received on said first snap-fitting means; and said second end of said top layer and said second end of said bottom layer being snap-fittingly received on said second snap-fitting means;

whereby, the spring member will automatically disassemble under the influence of an extraordinary lateral force.

2. A unit as defined in claim 1 said first and second snap fitting means comprising:

a first pad covering the first end of said strap member and a second pad covering the second end of said strap member;

a first strip overlying said first pad and disposed centrally thereof, and a second strip overlying said second pad and disposed centrally thereof;

said top and bottom layers further comprising:

a first top layer indent at the first end of said top layer and a second top layer indent at the second end of said top layer, a first bottom layer indent at the first end of said bottom layer and a second bottom layer indent at the second end of said bottom layer;

said first top layer indent and said first bottom layer indent being snap-fitted about said first strip, and said second top layer indent and said second bottom layer indent being snap-fitted about said second strip.

3. A sporting and exercising unit, comprising:

A) a foot receiving member;

B) a plastic spring member detachably attached to and disposed at the bottom of the foot receiving member, said spring member comprising:

i) a top, arched, layer having a first end and a second end;

ii) a bottom, arched, layer having a first end, a second end, a bottom surface and a top surface;

iii) spring rate and weight adjustment means having a first end and a second end, said spring rate and weight adjustment means being disposed between said top and bottom layers;

iv) the first end of the top layer and the first end of the bottom layer being disassemblingly attached to the first end of the spring rate and weight adjustment means, and the second end of the top layer and the second end of the bottom layer being disassemblingly attached to the second end of the spring rate and weight adjustment means;

and further including a sole having a first end and a second end;

means for detachably mounting said sole on said bottom surface of said bottom layer;

and wherein said means for detachably mounting comprises a first means at said first end of said bottom layer for releasably holding one end of said sole on the bottom surface of said bottom layer and a second means at the second end of said bottom layer for releasably holding the other end of said sole on the bottom surface of said bottom layer.

4. A unit as defined in claim 3 wherein said first means comprises a first pocket formed at the first end of said bottom layer on the bottom surface thereof and wherein said second means comprises a second pocket formed at the second end of said bottom layer on the bottom surface thereof;

the inner ends of said pockets forming between them a gap;

said sole being disposed in said gap.

5. A unit as defined in claim 4 and including a first step adjacent said first end of said sole and a second spaced step adjacent said second end of said sole;

the distance between said first and second steps being substantially equal to the distance of said gap.

6. A sporting and exercising unit, comprising:

A) a foot receiving member;

B) a plastic spring member detachably attached to and disposed at the bottom of the foot receiving member, said spring member comprising:

i) a top, arched, layer having a first end and a second end;

ii) a bottom, arched, layer having a first end, a second end, a bottom surface and a top surface;

iii) spring rate and weight adjustment means having a first end and a second end, said spring rate and weight adjustment means being disposed between said top and bottom layers;

iv) the first end of the top layer and the first end of the bottom layer being disassemblingly attached to the first end of the spring rate and weight adjustment means, and the second end of the top layer and the second end of the bottom layer being disassemblingly attached to the second end of the spring rate and weight adjustment means;

v) said spring rate and weight adjustment means comprising a strap member made of a single length of plastic material extending from the first end to the second end thereof having preselected portions, wherein the spring rate and the weight which the strap member can support is adjustable by whittling away said preselected portions of said strap member.

* * * * *